US009827798B2

(12) United States Patent
Bowers et al.

(10) Patent No.: US 9,827,798 B2
(45) Date of Patent: Nov. 28, 2017

(54) ASSEMBLIES, SYSTEMS, AND METHODS FOR APPLYING POSTAGE INDICIA TO ONE OR MORE MAILPIECE ON A HIGH SPEED MAIL SORTER

(71) Applicant: BELL AND HOWELL, LLC, Durham, NC (US)

(72) Inventors: Brian Bowers, Mundelein, IL (US); Walter S. Conard, Saratoga Springs, NY (US)

(73) Assignee: Fluence Automation LLC, Wheeling, IL (US)

( * ) Notice: Subject to any disclaimer, the term of this patent is extended or adjusted under 35 U.S.C. 154(b) by 0 days.

(21) Appl. No.: 14/757,837

(22) Filed: Dec. 23, 2015

(65) Prior Publication Data

US 2016/0332467 A1 Nov. 17, 2016

Related U.S. Application Data

(60) Provisional application No. 62/162,393, filed on May 15, 2015.

(51) Int. Cl.

| | |
|---|---|
| ***B41M 3/00*** | (2006.01) |
| ***G07B 17/00*** | (2006.01) |
| ***B07C 1/00*** | (2006.01) |

(52) U.S. Cl.

CPC ..... *B41M 3/00* (2013.01); *B07C 1/00* (2013.01); *G07B 17/00508* (2013.01); *G07B 2017/00516* (2013.01)

(58) Field of Classification Search

CPC .... B07C 1/02; B07C 1/18; B07C 1/00; B07C 5/34; B41M 3/00; G07B 17/00508; G07B 2017/00516

See application file for complete search history.

(56) References Cited

U.S. PATENT DOCUMENTS

| | | | |
|---|---|---|---|
| 7,805,384 | B1 | 9/2010 | Pagel |
| 2004/0036893 | A1 | 2/2004 | Sussmeier |

(Continued)

FOREIGN PATENT DOCUMENTS

| | | |
|---|---|---|
| EP | 2808845 | 12/2014 |
| EP | 3093825 A1 | 11/2016 |

OTHER PUBLICATIONS

Extended European Search Report for Application No. 15202933 dated Sep. 21, 2016.

(Continued)

*Primary Examiner* — David Banh

(74) *Attorney, Agent, or Firm* — Jenkins, Wilson, Taylor & Hunt, P.A.

(57) ABSTRACT

An assembly, system, and method for applying postage indicia to one or more mailpiece on a high speed mail sorter are disclosed. In some aspects, the assembly includes a diverter; a first and a second lane each including one or more zones, wherein the diverter is configured to alternately divert the one or more mailpiece to either the first or second lane; and one or more meter printers disposed on the first and second lane; wherein the one or more zones includes a first zone configured to decelerate the one or more mailpiece to printer speed, a second zone configured to transport the one or more mailpiece past the one or more meter printers at the printer speed, and a third zone configured to accelerate the one or more mailpiece to transport speed and merge the one or more mailpiece with mailpieces from each of the first and second lane.

23 Claims, 8 Drawing Sheets

(56) References Cited

U.S. PATENT DOCUMENTS

| | | | | |
|---|---|---|---|---|
| 2004/0057073 | A1* | 3/2004 | Egawa | G06F 3/1204 358/1.15 |
| 2004/0204788 | A1* | 10/2004 | Liberty | B42C 1/10 700/220 |
| 2005/0065896 | A1* | 3/2005 | Kummer, Jr. | G07B 17/00362 705/401 |
| 2005/0069365 | A1* | 3/2005 | Miller | G07B 17/00467 400/103 |
| 2005/0069367 | A1* | 3/2005 | Sussmeier | G07B 17/00467 400/608.4 |
| 2009/0071730 | A1* | 3/2009 | Hahn | G01G 19/005 177/145 |
| 2010/0063622 | A1 | 3/2010 | Fappiano | |
| 2010/0292833 | A1* | 11/2010 | Gorp | B07C 5/3412 700/221 |

OTHER PUBLICATIONS

Notice of Publication for European Application No. 15202933 dated Oct. 19, 2016.

* cited by examiner

ASSEMBLIES, SYSTEMS, AND METHODS FOR APPLYING POSTAGE INDICIA TO ONE OR MORE MAILPIECE ON A HIGH SPEED MAIL SORTER

TECHNICAL FIELD

The present subject matter relates to techniques and equipment for printing postage indicia. More particularly, the present subject matter relates to assemblies, systems, and methods for applying postage indicia to one or more mailpiece on a high speed mail sorter.

BACKGROUND

Franking systems or postage meters are generally used as stand-alone devices or are attached to moderate speed mail inserters in order to print postage indicia on an envelope. Limiting factors for high speed franking include the time needed to obtain a postage allocation from the postal security device (PSD) and to generate the printer commands. Postage meters are generally not used on high speed mail sorters that have transport belt speeds of 120 to 165 inches per second (ips) or greater due to the postage meter processing speed restrictions. Postage meter indiums require 300 dots per inch (DPI) or greater print resolution which cannot be achieved by cartridge printers at the transport speed utilized in a high throughput sorter.

Hence a need exists for assemblies, systems, and methods for applying postage indicia to one or more mailpiece on a high speed mail sorter, such that indicia may be printed on envelopes at high rates, such as rates exceeding 13 mailpieces per second.

SUMMARY

Assemblies, systems, and methods for applying postage indicia to one or more mailpiece on a high speed mail sorter are disclosed herein. In some aspects, an assembly for applying postage indicia to one or more mailpiece on a high speed mail sorter is disclosed. The assembly can comprise a diverter disposed along a transport path; a first lane and a second lane each comprising one or more zones, wherein the diverter is configured to alternately divert the one or more mailpiece to either the first lane or the second lane; one or more meter printers disposed on the first lane and the second lane, the one or more meter printers being configured to successively receive the one or more mailpiece on which to print the postage indicia; wherein the one or more zones comprise a first zone configured to decelerate the one or more mailpiece to printer speed, a second zone configured to transport the one or more mailpiece past the one or more meter printers at the printer speed, and a third zone configured to accelerate the one or more mailpiece to transport speed and merge the one or more mailpiece with mailpieces from each of the first lane and the second lane.

In some aspects, a system for applying postage indicia to one or more mailpiece on a high speed mail sorter. The system can comprise a transport path configured to transport the one or more mailpiece at transport speed; an assembly disposed along the transport path and comprising: a diverter disposed along the transport path, a first lane and a second lane each comprising one or more zones, wherein the diverter is configured to alternately divert the one or more mailpiece to either the first lane or the second lane, one or more meter printers disposed on the first lane and the second lane, the one or more meter printers being configured to successively receive the one or more mailpiece on which to print the postage indicia, wherein the one or more zones comprise a first zone configured to decelerate the one or more mailpiece to printer speed, a second zone configured to transport the one or more mailpiece past the one or more meter printers at the printer speed, and a third zone configured to accelerate the one or more mailpiece to the transport speed and merge the one or more mailpiece with mailpieces from each of the first lane and the second lane; and a controller configured to queue print data for printing the postage indicia on a respective mailpiece of the one or more mailpiece in synchronization with a respective one of the one or more meter printers receiving the respective mailpiece.

In some aspects, a method for applying postage indicia to one or more mailpiece on a high speed mail sorter is disclosed. The method can comprise transporting the one or more mailpiece along a transport path at transport speed; alternately diverting, by a diverter, the one or more mailpiece from the transport path to either a first lane or a second lane, wherein the first lane and the second lane each comprise one or more zones; successively receiving, at one or more printers disposed on the first lane and the second lane, the one or more mailpiece on which to print the postage indicia; and queueing, by a controller, print data for printing the postage indicia on a respective mailpiece of the one or more mailpiece in synchronization with a respective one of the one or more meter printers receiving the respective mailpiece; wherein the one or more zones comprise a first zone configured to decelerate the one or more mailpiece to printer speed, a second zone configured to transport the one or more mailpiece past the one or more meter printers at the printer speed, and a third zone configured to accelerate the one or more mailpiece to the transport speed and merge the one or more mailpiece with mailpieces from each of the first lane and the second lane.

Exemplary advantages and novel features are set forth in part in the description which follows, and in part will become apparent to those skilled in the art upon examination of the following and the accompanying drawings or may be learned by production or operation of the examples. Advantages of the present teachings may be realized and attained by practice or use of the methodologies, instrumentalities and combinations described herein.

BRIEF DESCRIPTION OF THE DRAWINGS

The drawing figures depict one or more implementations in accordance with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and circuitry have been described at a relatively high-level, without detail, in order to avoid unnecessarily obscuring aspects of the present teachings. Reference now is made in detail to the examples illustrated in the accompanying drawings and discussed below.

A sorter configuration that provides the latency needed for postal security device (PSD) access and for indicia printing is described herein. The required latency time is obtained by requesting the postage indicia in advance of the mailpiece reaching the printer over a transport path. Multiple transport paths are used to allow for having a reduced transport speed that is compatible with the printers which are utilized to print the indicia.

Figure 1:
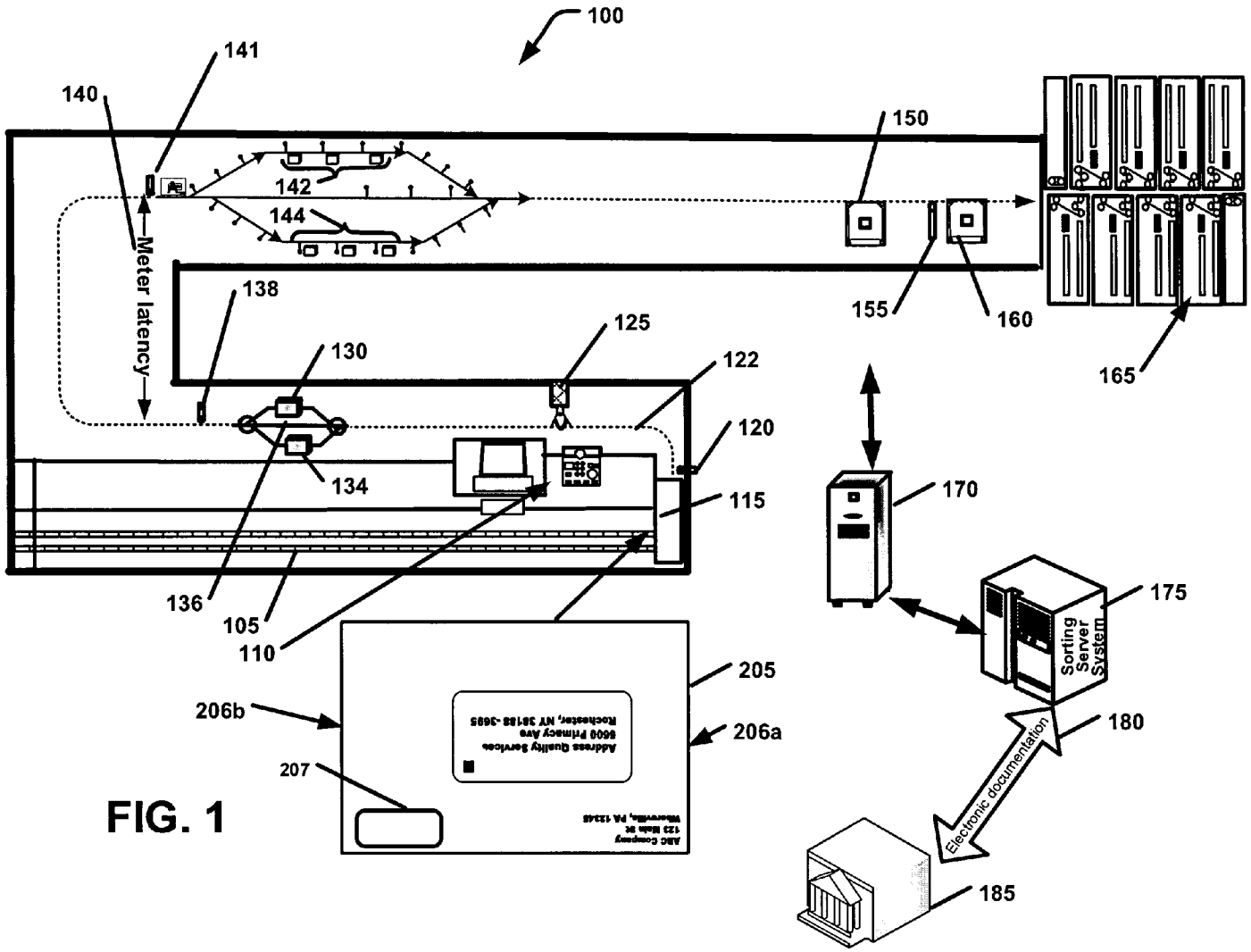
FIG. 1 is an exemplary illustration of a high speed mail sorter system including an assembly for applying postage indicia to one or more mailpiece on a high speed mail sorter.

FIG. 1 illustrates a high speed sorter or sorter system generally designated 100 that is configured for postage metering of mailpieces with variable sized envelopes 205. The sorter has a control panel, display, and keyboard generally designated 110 that are used to set up sorting jobs and control sorting operations. The control panel, display and keyboard 110 interfaces to the sorter control electronics and to the sorter control computer 170. The sorter control computer 170 receives job parameters and sends job results to the sorting server system 175. The sorting server 175 generates and transmits mailing documentation 180 to the Postal Authority 185 when processing is completed. The sorting server 175 receives and stores sort job setup data, meter parameters, image processing 125 directories plus other data as needed for operations via a network connection to other devices and to the postal authority. Envelopes 205 are placed on the magazine 105 so that the addressed side is facing the feeder 115. The envelopes are oriented upside down so that the indicia print area 207 of each of envelopes 205 is located at a constant distance from the top of envelope 205 as referenced to the magazine surface. If the envelopes of various sizes were run right side up, the generally designated indicia printers 142, may not be located at a fixed height from the bottom of the transport path 122. A lead edge generally designated 206*a* of the envelope 205 as it is placed on the magazine is identified in FIG. 1, while a trail edge generally designated 206*b* of the envelope 205 is the opposite edge of lead edge 206*a*.

Continuing with FIG. 1, envelope 205 processing starts when the feeder inserts an envelope into the nip of the transport path belts 122 and the envelope is detected by an input detector such as input photo sensor 120. The input detection event starts the mailpiece tracking as it moves along the transport path 122. The position of every mailpiece in the transport path 122 is tracked using numerous photo detectors and knowledge of the transport speed that is derived from measuring encoder counts. Mailpiece tracking through each of the zones depends on the placement of sufficient photo sensors and encoders to maintain speed and position data for every mailpiece in the transport. Maintaining speed and position data for every mailpiece in the franking transport 200, which is decoupled from the other zones and each lane is decoupled from the main transport, is accomplished by the mailpiece tracking algorithm and the sensor inputs. An exemplary transport speed is 165 ips (inches per second). Other speeds are possible and envisioned in accordance with this disclosure and may be accommodated in the design to meet design objectives. When the mailpiece reaches the image processor 125 the address data is read plus additional parameters in the key line, which is usually located above the address data. The key line may contain the weight data or weight class of the mailpiece. Other printed indicators may be included on the face of the envelope that identify the delivery class of the mailpiece, such as for example First Class, Standard Class and postage indicia to be used (permit indicia or meter indicia). Other indicators may be added as available or as required to provide information about the mailpiece and its contents. Height of the envelope 205 is determined by the imaging system or by photo sensors and the length is determined by measuring the time a tracking photo sensor is blocked versus the transport speed.

If weight data was not obtained from the image system 125, a scale system can be used such as a system comprising scale 1 designated 130 and scale 2 designated 134. Since the transport speed does not allow for sufficient settling time for the scale weighing element, a two scale system, as illustrated in FIG. 1, is utilized. A required settling time can be achieved with two scales where the mailpieces are alternated between the scales. A bypass path 136 is provided for mailpieces that do not need to be weighed. When the mailpiece reaches the meter enable photo sensor 138, the meter postage application request is generated. A separate thickness detector may be added to the transport before or upstream from the enable meter photo sensor 138. The mailpiece weight and dimensions are used for determining class of service and postage due.

Figure 2A:
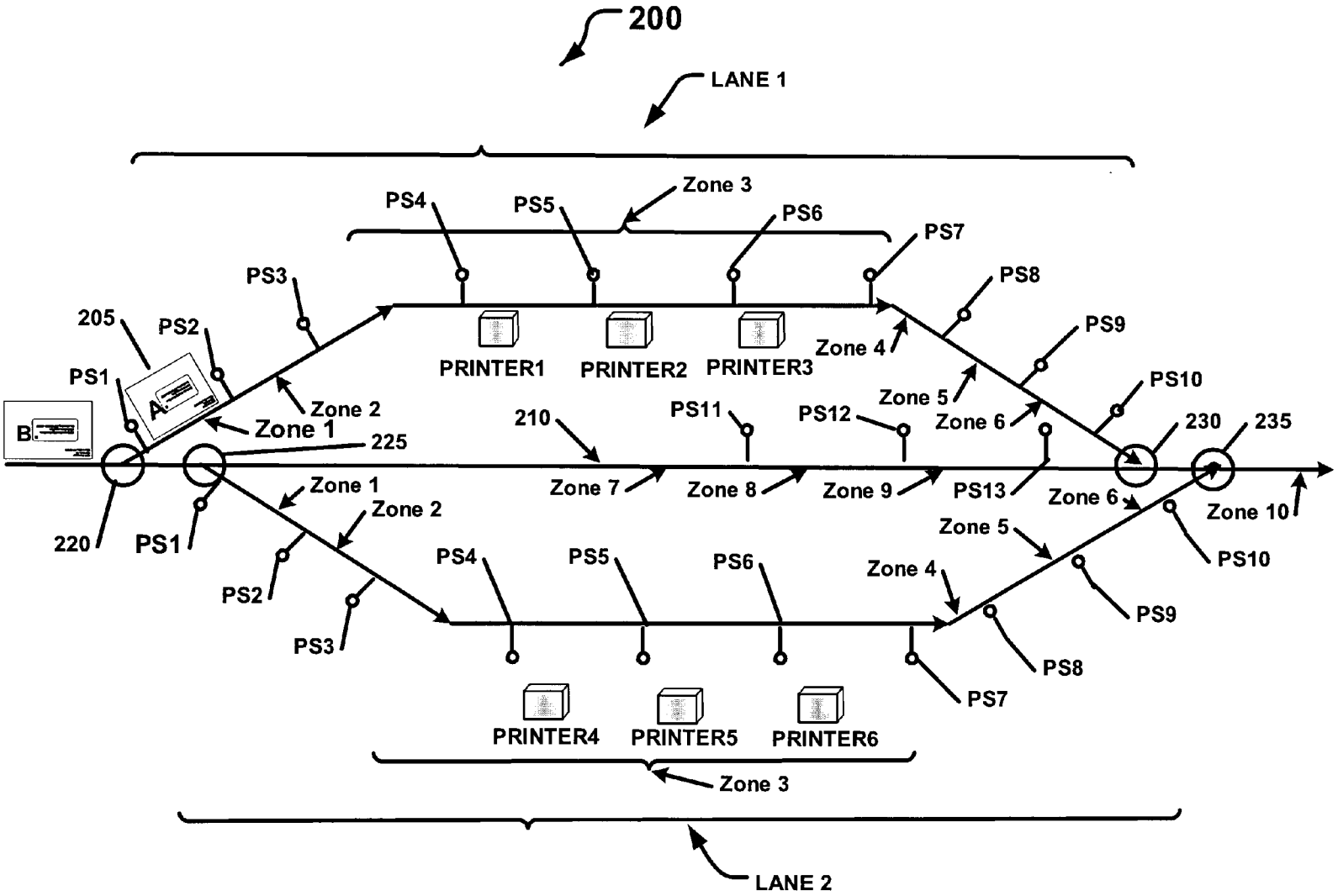
FIG. 2*a* is an exemplary illustration of an assembly for applying postage indicia to one or more mailpiece on a high speed mail sorter.

As shown particularly in FIG. 2*a*, six postage meters generally designated 142, 144 can be used in the franking transport configuration generally designated 200. The meters are utilized in a "round robin" process and/or configuration. In some aspects, a "round robin" process and/or configuration comprises meters disposed on different paths or lanes alternately receiving successive mailpieces that arrive on transport path 122. FIG. 2*a* illustrates two mailpieces as they enter the franking transport configuration. For example, first mailpiece (A) is diverted at position or diverter 220 to lane 1 and the indicium is printed by PRINTER1. The second mailpiece (B) is diverted such as at position or diverter 225 to lane 2 and the indicium is printed by PRINTER4. The third mailpiece (C) (FIG. 2*b*) is diverted at position or diverter 220 to lane 1 and the indicium is printed by PRINTER2. The fourth mailpiece (D) (FIG. 2*b*) is diverted such as at position or diverter 225 to lane 2 and the indicium is printed by PRINTERS. The fifth mailpiece (E) (FIG. 2*b*) is diverted at position or diverter 220 to lane 1 and the indicium is printed by PRINTER3. The sixth mailpiece (F) (FIG. 2*b*) is diverted such as at position or diverter 225 to lane 2 and the indicium is printed by PRINTER6. The round robin meter printer usage is continued for the balance of the sorting job for each successive mailpiece.

Figure 2B:
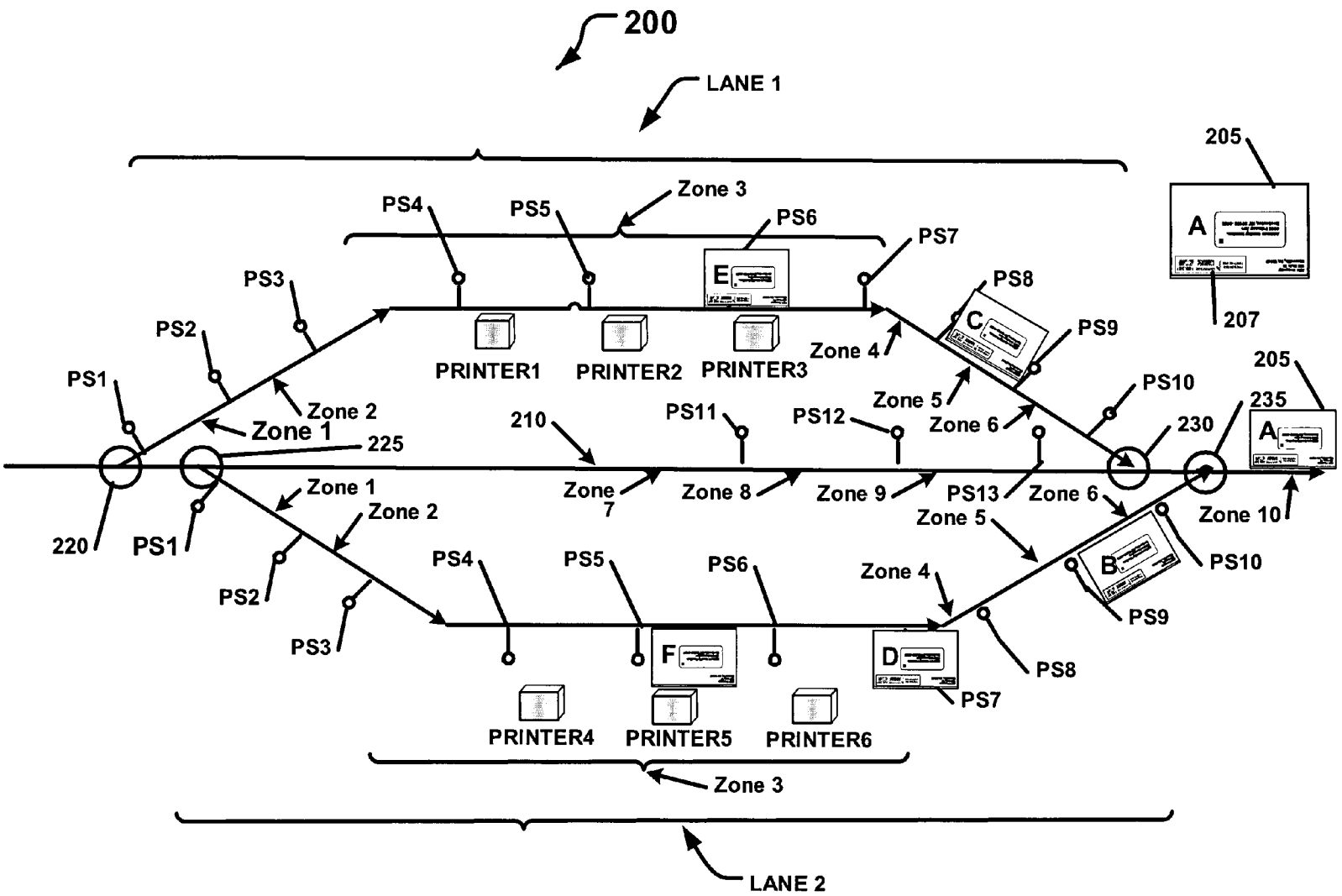
FIG. 2*b* is an exemplary illustration of the relative positions of six mailpieces as they transition through an assembly for applying postage indicia to one or more mailpiece on a high speed mail sorter.

FIG. 2*b* for an exemplary illustration of the relative positions of mailpieces (A)-(F) as they transition through the printer section 200. As illustrated in FIG. 2*b*, the indicium 207 is printed on mailpiece (A) by PRINTER1 and mailpiece (A) has advanced to the output zone 10. Mailpiece (B) indicium 207 is printed by PRINTER4, LANE 2 and has advanced to zone 6, LANE 2. Mailpiece (C) indicium 207 was printed by PRINTER2, LANE 1 and has advanced to zone 5, LANE 1. Mailpiece D indicium 207 is printed by PRINTERS, LANE 2 and has advanced to the end of zone 3, LANE 2 and is transitioning to zone 4, LANE 2. Mailpiece (E) indicium 207 is being printed by PRINTER3, LANE 1 in zone 3, LANE 1. Mailpiece (F) does not yet have any indicium (e.g., 207) printed on it. The indicium will be printed by PRINTER6, LANE 2 when the mailpiece is advanced in zone 3, LANE 2 and printing is initiated by photo sensor 6 (PS6) in zone 3, LANE 2. The printing sequence proceeds throughout the remainder of the sorting job.

The indicia content or meter indicia format is changed on demand as required for the mailpiece and sent to the meter printer. The type of image or indicia used can be based on customer or location that the mailpiece is being delivered to or by. The mailpiece could get a permit or a meter mark depending on to whom and how it is to be delivered and/or based on a customer profile of a customer that is providing the mail. In the past, meter PSD devices were not constructed or programmed to change the indicia on the fly by mailpiece. In the past, all processing with single indicium type was done in batch mode.

Referring back to FIG. 1, in the time required to transport the mailpiece from photo sensor 138 to a franking system mail detector, such as photo sensor 141 at the input to the franking transport, the meter computer 605 (FIG. 6) has requested and received the postage and security code from PSD 615 and has generated the print file for the indicium. The time for the mailpiece to be transported from photo sensor 138 to 141 is referred to as the meter latency time 140. Although dependent on the meter design, an exemplary latency time of 250 ms requires ~40 inches of transport at 165 ips. The print data is queued for each printer 610 in synchronization with the round robin sequence and mailpiece transport tracking. Print data is also sent to an indicia verifier 150 for verification that the indicium was printed and for verification the correct values were printed. Transport mailpiece tracking ensures that the indicium was printed on the correct mailpiece.

Figure 6:
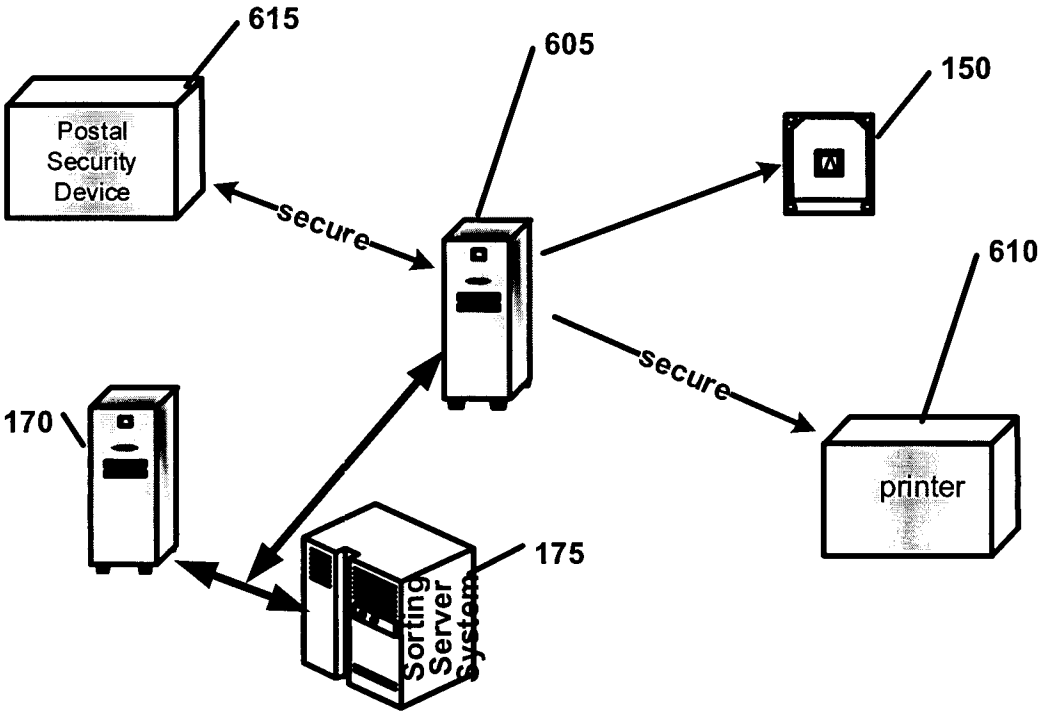
FIG. 6 is an exemplary illustration of an open postage meter architecture for applying postage indicia to one or more mailpiece on a high speed mail sorter.

In reference to FIG. 6, the postage meter used for this application can be an open meter architecture where the control is a computer 605 that is not an integral part of the PSD. The control computer 605 controls the PSD and printer operation and communicates with the sorter computer 170 and system server 175. Internet connectivity can be used for postage resets and for rate table updates. Other architectures may be used that enable one meter computer 605 to control more than one PSD and one printer 610. The meter can run in dynamic mode where the postage amount and class of service change for each mailpiece and where both meter indicia and permit indicia can be printed. Data records are maintained for each mailpiece sorted. These data records include presort results, delivery point barcode, postage applied or postage due for a permit. The mailpiece data is sorted as required in order to provide postal authority documentation about mailpiece characteristics and postage applied according to the mailings to be claimed and the associated mailer identification information. Mailpieces that cannot be co-mingled (i.e., grouped by postal requirements for a mailing to be submitted for delivery) are sorted to different bins and submitted separately to the postal authority. Additional mailpiece data is collected as required for client and postal authority reports.

The remaining sorter features include a delivery point barcode printer 155 and a delivery point barcode verifier 160. A group of stackers 165 are provided for sorting the mailpieces by class of service, indicia type, presort groupings and other parameters as required by the sorter operation.

Continuing with identification of the franking transport configuration and components as illustrated in FIG. 2*a*, the upside down mailpiece 205, with the return address leading, enters the transport on the left. Mailpiece (A) is diverted to lane 1 by diverter 220. Lane 1 has two transport zones (zone 1 and 2) that are used to decelerate the mailpiece (A) from transport speed to printer speed. Exemplary printer speed may comprise approximately 80 ips, although other printer speeds are contemplated. Photo sensors PS1, PS2 and PS3 are used by the control system to trigger speed changes in the zones. High performance motors are used to drive the zone transports such as but not limited to servo motors or stepper motors. Encoders may be integrated into each motor to obtain an accurate profile of speed during steady state run and during deceleration. The speed profile is used to update tracking data and to compensate for any slippage of the mailpiece in the transport. Zone 3 runs at print speed. Photo sensors PS4, PS5 and PS6 are used for tracking updates and to trigger the printers (e.g., PRINTER1, PRINTER2 and PRINTER3). Transport zones (zones 4, 5 and 6) are used to accelerate the mailpiece (A) from print speed back to transport speed. Photo sensors PS7, PS8, PS9 and PS10 are used by the control system to trigger speed changes in the zones. High performance motors are used to drive the zone transports such as but not limited to servo motors or stepper motors. Encoders may be integrated into each motor to obtain an accurate profile of speed during steady state run and during deceleration. The speed profile is used to update tracking data and to compensate for any slippage of the mailpiece in the transport. Zones 5 and 6 may have a speed profile that is less than printer speed or greater than transport speed in order to be able to correct for slippage, mailpiece length and mailpiece gap requirements. These speed adjustments are needed to ensure jam free mailpiece merge of the different transport lanes at the merge devices 230 and 235. Zone 10 runs at a steady state transport speed.

Mailpiece (B) is diverted to lane 2 by diverter 225. Lane 2 has the same zone and photo sensor configuration and hence has the same callout nomenclature for the zones and photo sensors and same functional features. The bypass lane 210 is used to bypass the printer lanes when no indicia print is required or because of data or tracking errors. Transport zones 7, 8 and 9 are used to correct for gap errors and to facilitate lane merge. A diverter may be added in the area before the franking transport or as part of the bypass to prevent jam or tracking errors from stopping the transport. A jam stop may cause a non-recoverable loss of tracking in the deceleration and acceleration zones plus indicia printing errors due to printing during the stop. A jam stop may cause the franking transport to have to be flushed of mailpieces currently in the transport. To aid in the recovery process, identification (ID) tags could be printed on each mailpiece to verify that that tracking is appropriate prior to printing the indicia.

Figure 3:
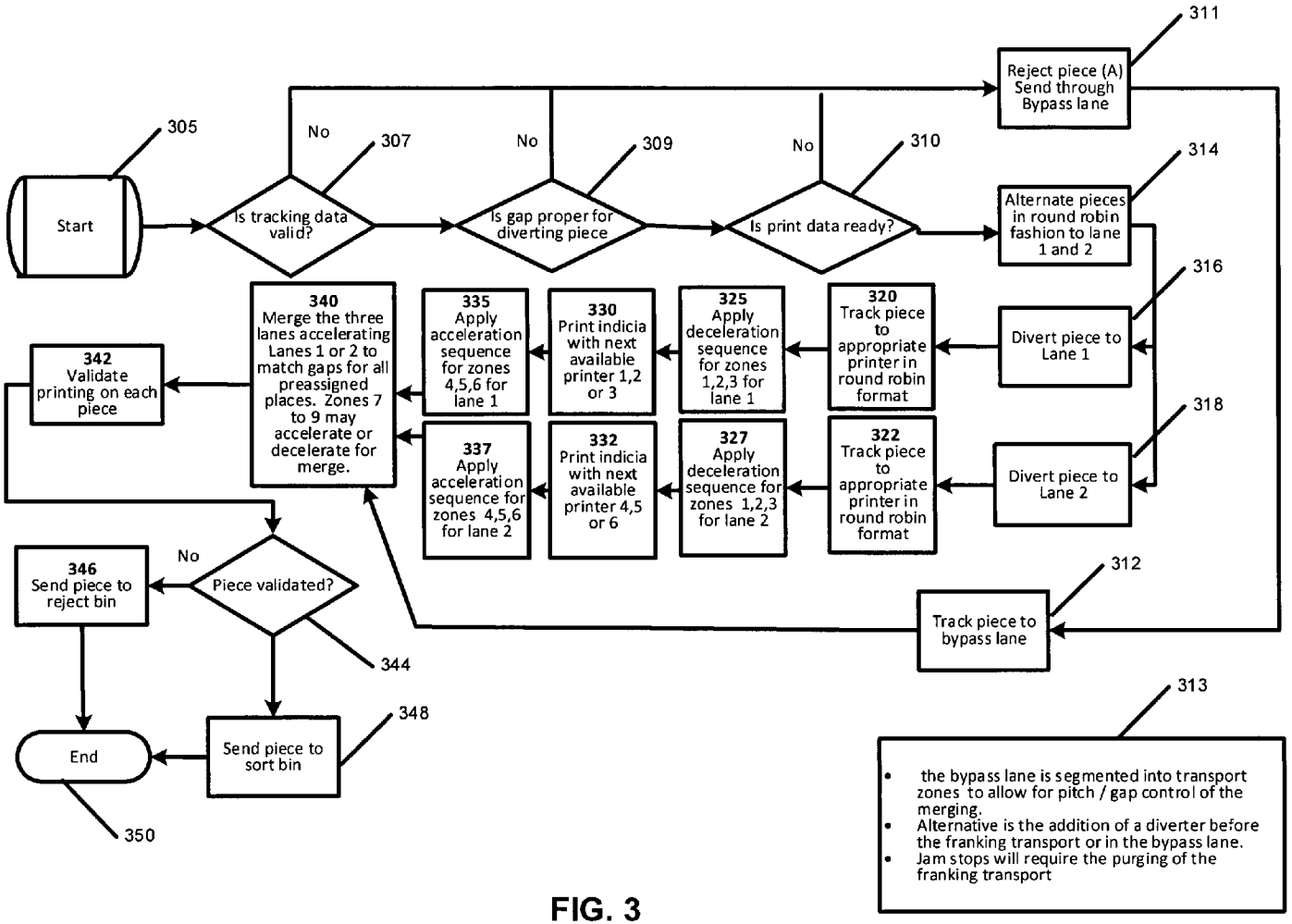
FIG. 3 is an exemplary process flow diagram for applying postage indicia to one or more mailpiece on a high speed mail sorter.

Turning now to FIG. 3, details are illustrated associated with the franking system transport control. Mailpiece tracking is commenced at step 305 with detection at the input photo sensor 120 continuing until the mailpiece is sorted in the stacker 165. When the meter latency period 140 is completed as indicated by the mailpiece detection by the franking system photo sensor 141, the mailpiece tracking validity is checked, step 307. If a tracking error is detected the mailpiece is routed to the bypass lane 210, step 311. The mailpiece in the bypass lane 210 is tracked, step 312, through the bypass 210 and merged, step 340, at the output of the franking transport 210. Diverters or jam stop purging may be implemented as an alternative as identified in note 313. If the tracking is within tolerance the tracking timing is updated and gap measurement, step 309, is made to verify that there is sufficient gap between mailpieces for downstream diverting and merging in the franking transport 200 and for sorting in the stackers 165. If a gap error is detected, the mailpiece is routed to the bypass lane 210, step 311. Diverters or jam stop purging may be implemented as an alternative as identified in note 313. The mailpiece in the bypass lane 210 is tracked, step 312, through the bypass 210 and merged, step 340, at the output of the franking transport 210. If the gap is within a predetermined tolerance, verification is made to determine that the meter indicium print data is available for the mailpiece (A) 205 entering the franking transport, step 310. If a print data error is detected, the mailpiece is routed to the bypass lane 210, step 311. Diverters or jam stop purging may be implemented as an alternative as identified in note 313. The mailpiece in the bypass lane 210 is tracked, step 312, through the bypass 210 and merged, step 340, at the output of the franking transport 210. Multiple print data errors may require a transport stop due to critical loss of print queue integrity during the meter latency period 140.

If the print queue integrity is correct, round robin processing of mailpieces is started or continued, step 314, and the mailpiece is diverted to lane 1, step 316, or lane 2, step 318. The mailpiece in lane 1 is tracked to next printer in the round robin sequence, step 320. The mailpiece in lane 2 is tracked to next printer in the round robin sequence, step 322. Before indicium printing can occur, the mailpiece in lane 1 or lane 2 can be decelerated from transport speed to printer speed in steps 325 or 327 respectively. The deceleration sequence is defined in FIG. 4. The printer round robin sequence, described above, is implemented in steps 330 and 332 respectively for lanes 1 and 2. Following the indicium printing, the mailpiece in lane 1 or lane 2 is accelerated from printer transport speed back to transport speed, steps 335 and 337 respectively. The acceleration sequence is described in FIG. 5. Validation of the correct indicium printing is done with indicium verifier 150 in step 342. If verification fails, step 344, the mailpiece is routed to a reject bin in the stacker 165, step 346. If verification of the indicium is successful the delivery point barcode is printed 155 and verified 160. The final step 348 is to sort the mailpiece in accordance with the sort scheme. The process is continued for all mailpieces in the sort job at which point the job is terminated, step 350.

Alternate configurations for the indicium verifier 150, delivery point barcode, printer 155, and/or barcode verifier maybe utilized depending on the format of the printed material on the mailpiece and on mailpiece size. For example, if mailpieces being processed are mixed mail (e.g., numerous sizes of mailpieces) a mailpiece is flipped 180 degrees to make it right side up and settled in a settling track to a bottom belt so that the bottom of each mailpiece is justified to the same reference relative to the barcode printer 155 location. The barcode printer 155 and verifier are relocated to the opposite side of the transport belt. If the delivery point barcode is printed in the vicinity of the indicium, the mailpiece does not have to be flipped since the printer can be positioned at a known distance from the top edge of the mailpiece even if mixed mail is being sorted. Other printer and verifier configurations will be utilized as required to accomplish the required print and verify functions.

Figure 4:
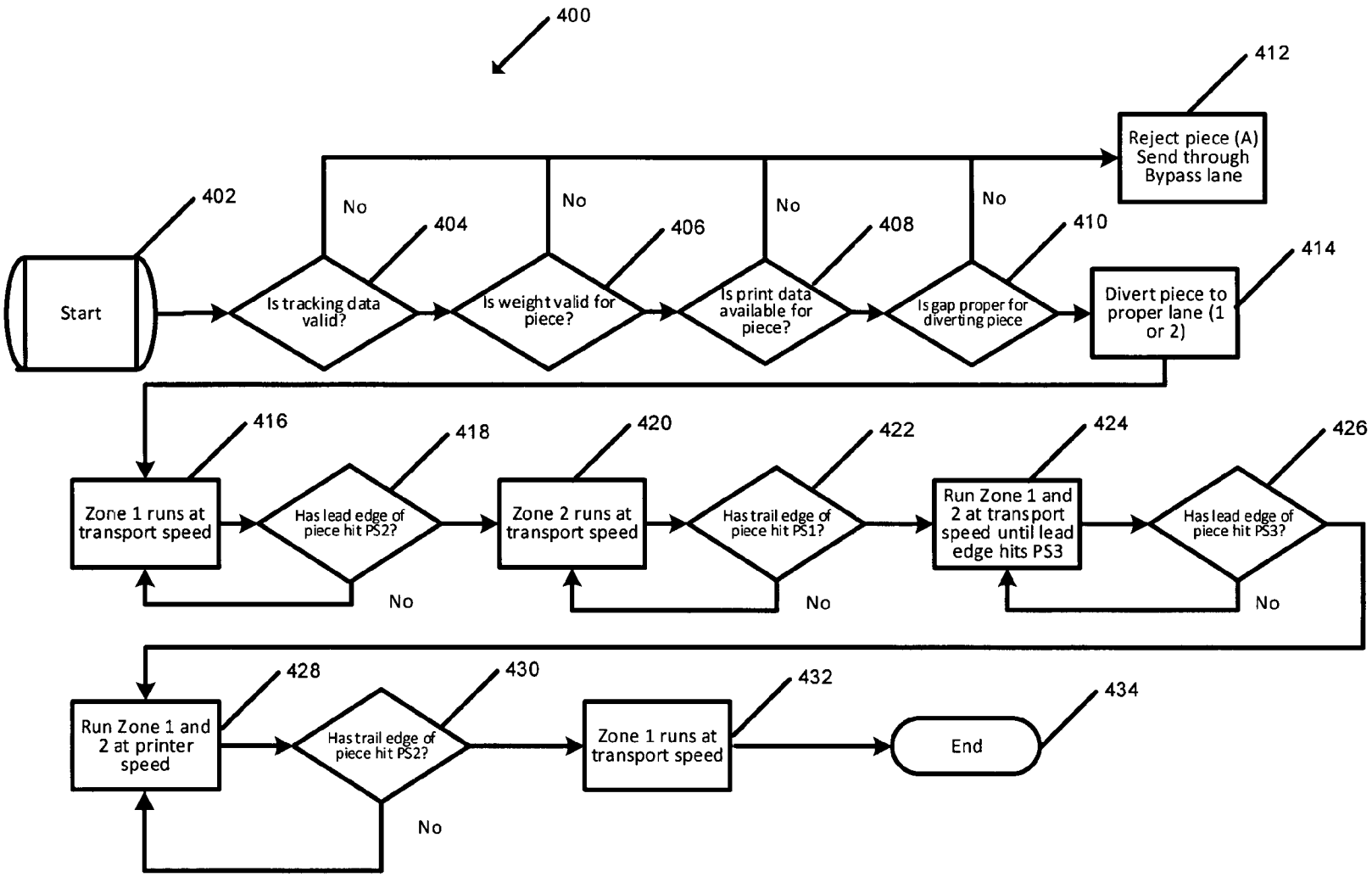
FIG. 4 is an exemplary process flow diagram of the mailpiece deceleration process to reduce the mailpiece speed from sorter transport speed to indicia print speed.

Referring now to FIG. 4, the deceleration sequence is described in further detail via process flow diagram 400. The deceleration sequence commences at step 402, with steps 404-410 comprising a process for verifying print queue integrity. When the meter latency period 140 is completed as indicated by the mailpiece detection by the franking system photo sensor 141, mailpiece tracking validity is checked in step 404. If a tracking error is detected, the mailpiece is routed to the bypass lane 210, step 412. If the tracking is within tolerance, a determination on whether weight is valid for the mailpiece is performed, step 406. If the weight is determined to be outside a predetermined tolerance, the mailpiece is routed to the bypass lane 210, step 412. If the weight is within a predetermined tolerance, verification is made to determine that the meter indicium print data is available for the mailpiece entering the franking transport, step 408. If a print data error is detected, the mailpiece is routed to the bypass lane 210, step 412. As an alternative, mailpieces associated with print data errors maybe transported through the desired lane with printing disabled for the associated mailpiece. Multiple print data errors may require a transport stop due to critical loss of print queue integrity during the meter latency period 140. Once the print data is detected, a gap measurement may be made and verified, step 410, that there is a sufficient gap between the mailpieces for downstream diverting and merging in the franking transport 200 and for sorting in the stackers 165. If a gap error is detected, the mailpiece is routed to the bypass lane 210, step 412.

If the print queue integrity is verified (e.g., steps 404-410), the deceleration process may continue onto step 414, in which the mailpiece is diverted to either zone 1 of either LANE 1 or LANE 2 for round robin processing. In zone 1, LANE 1 or zone 1, LANE 2, at step 416, zone 1 runs at transport speed. For example, transport speed may comprise 165 ips. Other speeds are possible and envisioned in accordance with this disclosure and may be accommodated in the design to meet design objectives. At step 418, a determination as to whether a lead edge (e.g., 206*a*, FIG. 1) has hit PS2 is made. As the mailpiece is conveyed oriented upside down so that the indicia print area of each of envelope is located at a constant distance from the top of envelope as referenced to the magazine surface, the lead edge of each mailpiece will be detected first by any photosensor. If the lead edge is not detected, zone 1 continues running at transport speed until the lead edge of the mailpiece arrives within the field of view of PS2. If the lead edge is detected, the mailpiece continues into zone 2 in either LANE 1 or LANE 2, depending on which lane the mailpiece has been diverted. In step 420, zone 2 maintains the same transport speed at which zone 1 was running. For example, if zone 1, LANE 1 is running at 165 ips, then zone 2, LANE 1 will also run at 165 ips. At step 422, a determination as to whether a trail edge (e.g., 206*b*, FIG. 1) has hit PS1 is made. As the mailpiece is conveyed oriented upside down so that the indicia print area of each of envelope is located at a constant distance from the top of envelope as referenced to the magazine surface, the trail edge of each mailpiece will be detected after the lead edge by a photosensor. If the trail edge is not detected, zone 2 continues running at transport speed until the trail edge of the mailpiece arrives within the field of view of PS1. If the trail edge is detected, zones 1 and 2 in either LANE 1 or LANE 2, depending on which lane the mailpiece has been diverted, continue to run at a same transport speed until the lead edge (e.g., 206*a*, FIG. 1) of the mailpiece is detected by PS3, step 424. At step 426, a determination as to whether a lead edge (e.g., 206*a*, FIG. 1) has hit PS3 is made. If the lead edge is not detected, zones 1 and 2 continue running at transport speed until the lead edge of the mailpiece arrives within the field of view of PS3. If the lead edge is detected, zones 1 and 2 in either LANE 1 or LANE 2, depending on which lane the mailpiece has been diverted, are decelerated from transport speed to printer speed so that the speed of the mailpiece is decreased, step 428. For example, printer speed may comprise approximately 80 ips to print a 300 dpi data matrix. Other speeds are possible and envisioned in accordance with this disclosure and may be accommodated in the design to meet design objectives.

At step 430, a determination as to whether a trail edge (e.g., 206*b*, FIG. 1) has hit PS2 is made. If the trail edge is not detected, zones 1 and 2 continue running at printer speed until the trail edge of the mailpiece arrives within the field of view of PS2. If the trail edge is detected, zone 1 in either LANE 1 or LANE 2, depending on which lane the mailpiece has been diverted, accelerates back to transport speed in preparation for the next mailpiece, step 432. The deceleration process then terminates for that mailpiece, step 434.

Figure 5:
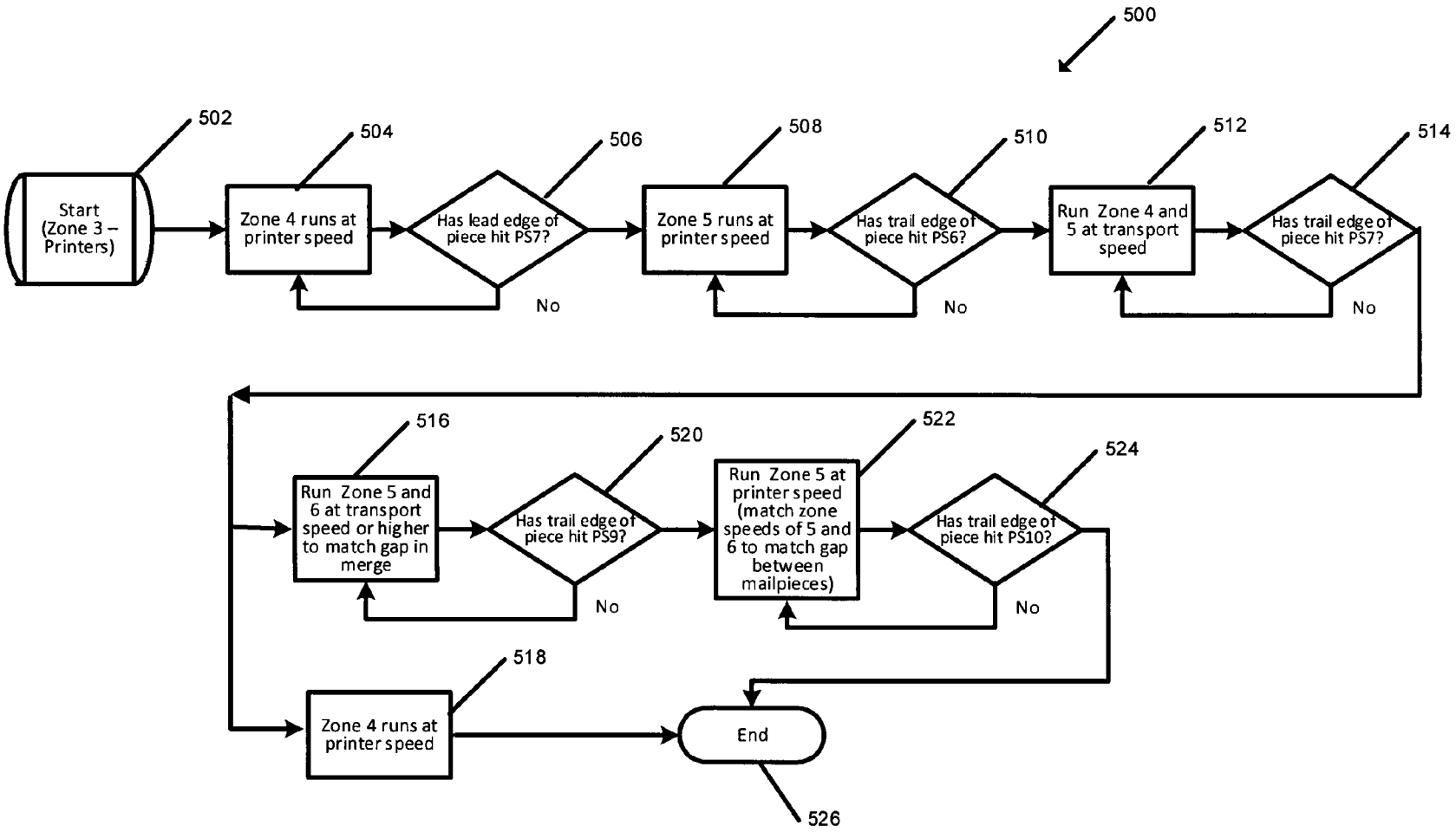
FIG. 5 is an exemplary process flow diagram of the mailpiece acceleration process to increase the mailpiece speed from indicia transport print speed to sorter transport speed.

Referring now to FIG. 5, the acceleration sequence is described in further detail via process flow diagram 500. The acceleration sequence commences at step 502, which begins after a mailpiece has been decelerated from transport speed to printer speed in zones 1-2 and conveyed to a printer in zone 3 at printer speed, either in LANE 1 or LANE 2, depending on which lane the mailpiece has been diverted. After printing, the mailpiece continues to zone 4 in either LANE 1 or LANE 2, depending on which lane the mailpiece has been diverted. In step 504, zone 4 runs at a same printer speed at which zone 3 is running. At step 506, a determination as to whether a lead edge (e.g., 206*a*, FIG. 1) has hit PS7 is made. If the lead edge is not detected, zone 4 continues running at printer speed until the lead edge of the mailpiece arrives within the field of view of PS7. If the lead edge is detected, the mailpiece continues into zone 5 in either LANE 1 or LANE 2, depending on which lane the mailpiece has been diverted. In step 508, zone 5 runs at a same printer speed at which zone 4 is running At step 510, a determination as to whether a trail edge (e.g., 206*b*, FIG. 1) has hit PS6 is made. If the trail edge is not detected, zone 5 continues running at printer speed until the trail edge of the mailpiece arrives within the field of view of PS6. If the trail edge is detected, zones 4 and 5 in either LANE 1 or LANE 2, depending on which lane the mailpiece has been diverted, are accelerated from printer speed back to transport speed so that the speed of the mailpiece is increased, step 512.

At step 514, a determination as to whether a trail edge (e.g., 206*b*, FIG. 1) has hit PS7 is made. If the trail edge is not detected, zones 4 and 5 continue running at transport speed until the trail edge of the mailpiece arrives within the field of view of PS7. If the trail edge is detected, the mailpiece continues into zone 6 in either LANE 1 or LANE 2, depending on which lane the mailpiece has been diverted. In step 516, zones 5 and 6 in either LANE 1 or LANE 2, depending on which lane the mailpiece has been diverted, continue to run at transport speed or at a speed higher in order to match a gap in the merge. Additionally, if the trail edge is detected, zone 4 is decelerated to run from transport speed to printer speed, step 518, in preparation for the next mailpiece.

At step 520, following step 516, a determination as to whether a trail edge (e.g., 206*b*, FIG. 1) has hit PS9 is made. If the trail edge is not detected, zones 5 and 6 continue running at transport speed or higher until the trail edge of the mailpiece arrives within the field of view of PS9. If the trail edge is detected, zone 5 in either LANE 1 or LANE 2, depending on which lane the mailpiece has been diverted, is decelerated from transport speed or higher to printer speed, step 522. Notably, in step 522, zone 6 is matched to the speed of zone 5 in order to match the gap between the mailpieces. At step 524, a determination as to whether a trail edge (e.g., 206*b*, FIG. 1) has hit PS10 is made. If the trail edge is not detected, zone 5 continues running at printer speed until the trail edge of the mailpiece arrives within the field of view of PS10. If the trail edge is detected, the acceleration process is terminated for that mailpiece, step 526.

As shown by the above description, functions relating to the operation of the high speed franking system on a mail sorter 100 are implemented in the hardware and controlled by one or more computers. The sorting server 175 can be implemented with a server architecture, and the sorter control computer 170 and peripheral computers such as required for the meter 605, verifiers 150 and 160 plus the image system 125 can be implemented with a personal computer architecture. All of the computers are connected to the high speed franking system on a mail sorter 100 and are connected to each other via a network as shown in FIG. 1. Discrete interfaces are also used, such as USB or TTL for communication to the high speed franking system on a mail sorter 100. Although special purpose devices may be used, such devices also may be implemented using one or more hardware platforms intended to represent a general class of data processing device commonly used to run "server" programming so as to implement the functions discussed above, albeit with an appropriate network connection for data communication.

As known in the data processing and communications arts, a general-purpose computer typically comprises a central processor or other processing device, an internal communication bus, various types of memory or storage media (RAM, ROM, EEPROM, cache memory, disk drives etc.) for code and data storage, and one or more network interface cards or ports for communication purposes. The software functionalities involve programming, including executable code as well as associated stored data. The software code is executable by the general-purpose computer that functions as the control processor 170 and/or the associated terminal device. In operation, the code is stored within the general-purpose computer platform. At other times, however, the software may be stored at other locations and/or transported for loading into the appropriate general-purpose computer system. Execution of such code by a processor of the computer platform enables the platform to implement the methodology for tracking of mail items through a postal authority network with reference to a specific mail target, in essentially the manner performed in the implementations discussed and illustrated herein.

The subject matter disclosed herein can be implemented in software in combination with hardware and/or firmware. For example, the subject matter described herein can be implemented in software executed by a processor or processing unit. In one exemplary implementation, the subject matter described herein can be implemented using a computer readable medium having stored thereon computer executable instructions that when executed by a processor of a computer control the computer to perform steps. Exemplary computer readable mediums suitable for implementing the subject matter described herein include non-transitory devices, such as disk memory devices, chip memory devices, programmable logic devices, and application specific integrated circuits. In addition, a computer readable medium that implements the subject matter described herein can be located on a single device or computing platform or can be distributed across multiple devices or computing platforms.

Figure 7:
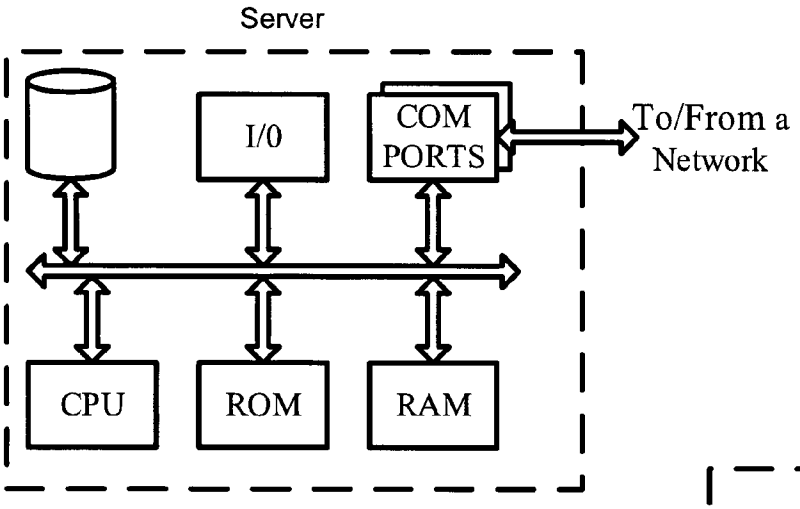
FIG. 7 is an exemplary illustration of a network or host computer platform, as may typically be used to implement a server.
Figure 8:
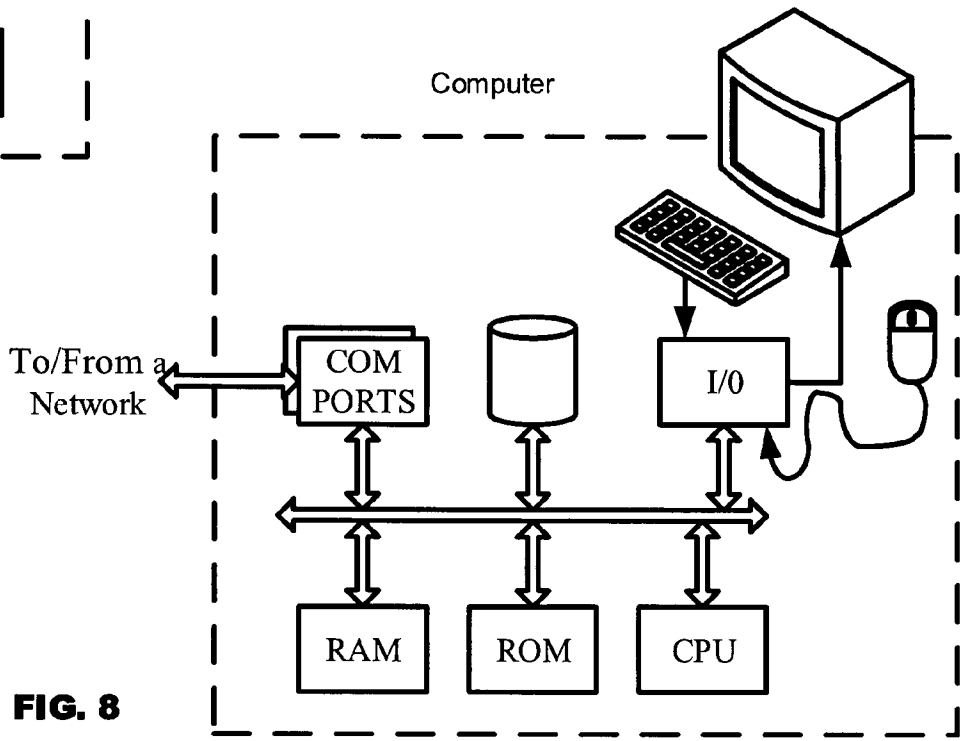
FIG. 8 is an exemplary illustration of a computer with user interface elements, as may be used to implement a personal computer or other type of work station or terminal device.

FIGS. 7 and 8 provide functional block diagram illustrations of general purpose computer hardware platforms. FIG. 7 illustrates a network or host computer platform, as may typically be used to implement a server. FIG. 8 depicts a computer with user interface elements, as may be used to implement a personal computer or other type of work station or terminal device, although the computer of FIG. 8 may also act as a server if appropriately programmed. It is believed that those skilled in the art are familiar with the structure, programming and general operation of such computer equipment and, as a result, the drawings should be self-explanatory.

For example, control processor 150 may be a PC based implementation of a central control processing system like that of FIG. 8, or may be implemented on a platform configured as a central or host computer or server like that of FIG. 7. Such a system typically contains a central processing unit (CPU), memories and an interconnect bus. The CPU may contain a single microprocessor (e.g. a Pentium microprocessor), or it may contain a plurality of microprocessors for configuring the CPU as a multi-processor system. The memories include a main memory, such as a dynamic random access memory (DRAM) and cache, as well as a read only memory, such as a PROM, an EPROM, a FLASH-EPROM or the like. The system memories also include one or more mass storage devices such as various disk drives, tape drives, etc.

In operation, the main memory stores at least portions of instructions for execution by the CPU and data for processing in accord with the executed instructions, for example, as uploaded from mass storage. The mass storage may include one or more magnetic disk or tape drives or optical disk drives, for storing data and instructions for use by CPU. For example, at least one mass storage system in the form of a disk drive or tape drive, stores the operating system and various application software. The mass storage within the computer system may also include one or more drives for various portable media, such as a floppy disk, a compact disc read only memory (CD-ROM), or an integrated circuit non-volatile memory adapter (i.e. PC-MCIA adapter) to input and output data and code to and from the computer system.

The system also includes one or more input/output interfaces for communications, shown by way of example as an interface for data communications with one or more other processing systems. Although not shown, one or more such interfaces may enable communications via a network, e.g., to enable sending and receiving instructions electronically. The physical communication links may be optical, wired, or wireless.

The computer system may further include appropriate input/output ports for interconnection with a display and a keyboard serving as the respective user interface for the processor/controller. For example, a printer control computer in a document factory may include a graphics subsystem to drive the output display. The output display, for example, may include a cathode ray tube (CRT) display, or a liquid crystal display (LCD) or other type of display device. The input control devices for such an implementation of the system would include the keyboard for inputting alphanumeric and other key information. The input control devices for the system may further include a cursor control device (not shown), such as a mouse, a touchpad, a trackball, stylus, or cursor direction keys. The links of the peripherals to the system may be wired connections or use wireless communications.

The computer system runs a variety of applications programs and stores data, enabling one or more interactions via the user interface provided, and/or over a network to implement the desired processing, in this case, including those for tracking of mail items through a postal authority network with reference to a specific mail target, as discussed above.

The components contained in the computer system are those typically found in general purpose computer systems. Although summarized in the discussion above mainly as a PC type implementation, those skilled in the art will recognize that the class of applicable computer systems also encompasses systems used as host computers, servers, workstations, network terminals, and the like. In fact, these components are intended to represent a broad category of such computer components that are well known in the art. The present examples are not limited to any one network or computing infrastructure model—i.e., peer-to-peer, client server, distributed, etc.

Hence aspects of the techniques discussed herein encompass hardware and programmed equipment for controlling the relevant document processing as well as software programming, for controlling the relevant functions. A software or program product, which may be referred to as a "program article of manufacture" may take the form of code or executable instructions for causing a computer or other programmable equipment to perform the relevant data processing steps, where the code or instructions are carried by or otherwise embodied in a medium readable by a computer or other machine. Instructions or code for implementing such operations may be in the form of computer instruction in any form (e.g., source code, object code, interpreted code, etc.) stored in or carried by any readable medium.

Such a program article or product therefore takes the form of executable code and/or associated data that is carried on or embodied in a type of machine readable medium. "Storage" type media include any or all of the memory of the computers, processors or the like, or associated modules thereof, such as various semiconductor memories, tape drives, disk drives and the like, which may provide non-transitory storage at any time for the software programming. All or portions of the software may at times be communicated through the Internet or various other telecommunication networks. Such communications, for example, may enable loading of the relevant software from one computer or processor into another, for example, from a management server or host computer into the image processor and comparator. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible "storage" media, terms such as computer or machine "readable medium" refer to any medium that participates in providing instructions to a processor for execution.

Hence, a machine readable medium may take many forms, including but not limited to, a tangible storage medium, a carrier wave medium or physical transmission medium. Non-volatile storage media include, for example, optical or magnetic disks, such as any of the storage devices in any computer(s) or the like. Volatile storage media include dynamic memory, such as main memory of such a computer platform. Tangible transmission media include coaxial cables; copper wire and fiber optics, including the wires that comprise a bus within a computer system. Carrier-wave transmission media can take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer can read programming code and/or data. Many of these forms of computer readable media may be involved in carrying one or more sequences of one or more instructions to a processor for execution.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. An assembly for applying postage indicia to two or more mailpieces on a high speed mail sorter, the assembly comprising:

a diverter disposed along an inlet portion of a transport path;

a first lane and a second lane each comprising two or more zones;

two or more meter printers disposed on each of the first lane and the second lane, respectively, the two or more meter printers being configured to successively receive the two or more mailpieces on which to print the postage indicia;

wherein the two or more zones of each of the first lane and the second lane, respectively, comprise and are configured such that:

a first zone located at an inlet to the first or second lane from the transport path, in or on which first zone the two or more mailpieces are decelerated to a printer speed before the two or more mailpieces arrive at the two or more meter printers, a second zone in which the two or more mailpieces are transported past the two or more meter printers at the printer speed, and a third zone in which the two or more mailpieces are accelerated to the transport speed and output from the first lane or the second lane into an outlet portion of the transport path, wherein the two or more mailpieces output from the first and second lanes into the outlet transport path are merged together on the outlet transport path at the transport speed, and wherein the diverter is configured to alternately divert the two or more mailpieces directly into the first zone of either the first lane or the second lane, respectively.

2. The assembly of claim 1, comprising a bypass lane disposed after the diverter in either the first lane or the second lane, the bypass lane being configured to transport the two or more mailpieces when the postage indicia is not required or because of one or more errors.

3. The assembly of claim 1, comprising:

at least one motor configured to drive the two or more zones and at least one encoder, which is integrated into the at least one motor and configured to determine an accurate speed profile during the acceleration to the transport speed and during the deceleration to the printer speed.

4. The assembly of claim 1, wherein a respective one of the two or more meter printers are configured to receive from a postage meter system, based on mailpiece characteristics of a respective mailpiece of the two or more mailpieces, indicium print instructions comprising print data for printing the postage indicia on the respective mailpiece received.

5. A system for applying postage indicia to two or more mailpieces on a high speed mail sorter, the system comprising:

a transport path configured to transport the two or more mailpieces at transport speed;

an assembly disposed along the transport path and comprising:

a diverter disposed along an inlet portion of the transport path, a first lane and a second lane each comprising two or more zones, and two or more meter printers disposed on each of the first lane and the second lane, respectively, the two or more meter printers being configured to successively receive the two or more mailpieces on which to print the postage indicia, wherein the two or more zones of each of the first lane and the second lane, respectively, comprise and are configured such that:

a first zone located at an inlet to the first or second lane from the inlet portion of the transport path, in or on which first zone the two or more mailpieces are decelerated to a printer speed before the two or more mailpieces arrive at the two or more meter printers, a second zone in which the two or more mailpieces are transported past the two or more meter printers at the printer speed, and a third zone in which the two or more mailpieces are accelerated to the transport speed and output from the first lane or the second lane into an outlet portion of the transport path, wherein the two or more mailpieces output from the first and second lanes into the outlet transport path are merged together on the outlet transport path at the transport speed, and wherein the diverter is configured to alternately divert the two or more mailpieces directly into the first zone of either the first lane or the second lane, respectively; and a controller configured to queue print data for printing the postage indicia on a respective mailpiece of the two or more mailpieces in synchronization with a respective one of the two or more meter printers receiving the respective mailpiece.

6. The system of claim 5, comprising an input detector disposed along the transport path before the assembly and configured to detect the two or more mailpieces on the transport path; and to initiate tracking of the two or more mailpieces.

7. The system of claim 5, comprising an image processor disposed along the transport path before the assembly that is configured to read mailpiece characteristics of the two or more mailpieces, wherein the mailpiece characteristics include address data, weight data, weight class, delivery class, and/or the postage indicia.

8. The system of claim 5, wherein the postage indicia is updated for each of the two or more mailpieces.

9. The system of claim 5, wherein the controller is configured to maintain data records for each of the two or more mailpieces, wherein the data records include presort results, delivery point barcode, postage applied, and/or postage due for a permit.

10. The system of claim 5, wherein the assembly comprises a bypass lane disposed after the diverter in either the first lane or the second lane, the bypass lane being configured to transport the two or more mailpieces when the postage indicia is not required or because of one or more errors.

11. The system of claim 5, wherein the assembly comprises:

at least one motor configured to drive the two or more zones; and at least one encoder integrated into the at least one motor and configured to determine an accurate speed profile during the acceleration to the transport speed and during the deceleration to the printer speed; and a plurality of position detectors configured to track positions of the two or more mailpieces along the transport path, the first lane, and/or the second lane, wherein the positions of the two or more mailpieces are used by the controller to adjust a speed of the third zone so a gap between the two or more mailpieces on the outlet portion of the transport path can be controlled.

12. The system of claim 5, wherein each of the two or more meter printers is paired with a postage security device (PSD) of the postage meter system, such that a paired meter printer is configured to receive from its corresponding PSD of the postage meter system indicium print instructions generated from mailpiece characteristics received by the corresponding PSD for the respective mailpiece and comprising the print data for printing the postage indicia on the respective mailpiece received.

13. The system of claim 12, comprising one or more photosensor disposed immediately after one or more image sensor and/or scale assembly along the transport path and configured to detect the two or more mailpieces, wherein the corresponding PSD is configured to load the indicium print instructions into the paired meter printer following detection of the respective mailpiece by the one or more photosensor.

14. A method for applying postage indicia to two or more mailpieces on a high speed mail sorter, the method comprising:

transporting the two or more mailpieces along a transport path at transport speed;

alternately diverting, by a diverter, the two or more mailpieces from an inlet portion of the transport path to either a first lane or a second lane, wherein the first lane and the second lane each comprise two or more zones;

successively receiving, at two or more meter printers disposed on each of the first lane and the second lane, respectively, the two or more mailpieces on which to print the postage indicia; and queueing, by a controller, print data for printing the postage indicia on a respective mailpiece of the two or more mailpieces in synchronization with a respective one of the two or more meter printers receiving the respective mailpiece;

wherein the two or more zones of each of the first lane and the second lane respectively comprise:

a first zone located at an inlet to the first or second lane from the transport path, in or on which first zone the two or more mailpieces are decelerated to a printer speed before the two or more mailpieces arrive at the two or more meter printers, a second zone in which the two or more mailpieces are transported past the two or more meter printers at the printer speed, and a third zone in which the two or more mailpieces are accelerated to the transport speed and from of the first lane or the second lane into an outlet portion of the transport path, wherein the two or more mailpieces output from the first and second lanes into the outlet transport path are merged together on the outlet transport path at the transport speed.

15. The method of claim 14, comprising detecting, by an input detector disposed along the transport path before the assembly, the two or more mailpieces on the transport path; and initiating, by the input detector, tracking of the two or more mailpieces, wherein detecting the two or more mailpieces comprises detecting a position between the two or more mailpieces, and wherein the positions of the two or more mailpieces are used by the controller to adjust a speed of the third zone so a gap between the two or more mailpieces on the outlet portion of the transport path can be controlled.

16. The method of claim 14, comprising reading, by an image processor disposed along the transport path before the assembly, mailpiece characteristics of the two or more mailpieces, wherein the mailpiece characteristics include address data, weight data, weight class, delivery class, and/or the postage indicia.

17. The method of claim 14, comprising updating the postage indicia for each of the two or more mailpieces.

18. The method of claim 14, comprising maintaining, by the controller, data records for each of the two or more mailpieces, wherein the data records include presort results, delivery point barcode, postage applied, and/or postage due for a permit.

19. The method of claim 14, comprising diverting the two or more mailpieces to a bypass lane, disposed in either the first or the second lane, when the postage indicia is not required for the two or more mailpieces or because of one or more errors associated with the two or more mailpieces.

20. The method of claim 14, comprising driving, by at least one motor, the two or more zones of the assembly; and determining, by at least one encoder integrated into the at least one motor, an accurate speed profile during the acceleration to the transport speed and during the deceleration to the printer speed.

21. The method of claim 14, comprising receiving, by the two or more meter printers, based on mailpiece characteristics of the respective mailpiece of the two or more mailpieces, indicium print instructions from a postage meter system for the respective mailpiece received, wherein the indicium print instructions comprise the print data for printing the postage indicia on the respective mailpiece received.

22. The method of claim 14, comprising:

alternately diverting a first mailpiece to a first meter printer of the two or more meter printers disposed in a first printer speed transport zone of the first lane and a second mailpiece to a first meter printer of the two or more meter printers disposed in a first printer speed transport zone of the second lane, where the first and second lanes are parallel to one another; and printing a first postage indicia by the first meter printer in the first printer speed transport zone of the first lane and printing a second postage indicia by the first meter printer in the first printer transport zone of the second lane;

wherein each successive mailpiece after the first and second mailpieces is alternately diverted to either the first lane or the second lane and a successive printer after the first meter printer in each lane is configured to print postage indicia on each of the successive mailpieces.

23. The method of claim 14, wherein the two or more meter printers are utilized in a round robin configuration.

* * * * *